United States Patent [19]

Niwa et al.

[11] 4,134,380

[45] Jan. 16, 1979

[54] AUTOMOBILE OIL PAN ASSEMBLY

[75] Inventors: Takao Niwa; Yasushi Sato, both of Susono, Japan

[73] Assignee: Toyota Jidosha Kogyo Kabushiki Kaisha, Aichiken, Japan

[21] Appl. No.: 760,259

[22] Filed: Jan. 18, 1977

[30] Foreign Application Priority Data

Nov. 22, 1976 [JP] Japan ..... 51-139471

[51] Int. Cl.[2] ..... F02M 17/00

[52] U.S. Cl. ..... 123/142.5 R; 123/196 R; 184/1.5; 184/6.5

[58] Field of Search ..... 123/179 A, 196 R, 142.5, 123/179 H; 184/1.5, 6.5

[56] References Cited

U.S. PATENT DOCUMENTS

| | | | |
|---|---|---|---|
| 1,000,188 | 8/1911 | Morse | 123/142.5 R |
| 1,316,547 | 9/1919 | Waldron | 123/196 R |
| 3,014,554 | 12/1961 | Etchells | 123/196 R |

*Primary Examiner*—Ronald H. Lazarus

*Attorney, Agent, or Firm*—Toren, McGeady and Stanger

[57] ABSTRACT

An oil pan assembly for an automotive vehicle is formed with an oil pan which is divided by a partition wall into a first and a second chamber. Oil is pumped by an oil pump from the first chamber into the engine of the vehicle through a pipe including an oil strainer. The partition wall is provided with a temperature responsive valve which closes when temperature of the oil is below a predetermined level to cut off flow communication between the second chamber and the first chamber. Thus, with the valve closed, all the oil going to the vehicle engine is drawn from the first chamber. When the temperature of the oil rises above a predetermined level, the temperature responsive valve opens thereby permitting oil circulation from the second chamber into the first chamber.

5 Claims, 2 Drawing Figures

AUTOMOBILE OIL PAN ASSEMBLY

BACKGROUND OF THE INVENTION

The present invention relates generally to lubrication systems for the internal combustion engine of an automotive vehicle and more particularly to the structure of an oil pan assembly for such vehicles. The invention more specifically relates to an oil pan or oil pump assembly which is especially suitable for facilitating starting of an engine during cold weather.

As is well known to those skilled in the art, an oil pan or oil pump is usually provided within the lower regions of an internal combustion engine to operate as an oil storage facility. In the prior art engines, it usually requires a considerable length of time to raise the temperature of the oil when the engine is started at low ambient temperature conditions, for example in the winter or in environments involving cold weather. Because of the time required to raise the temperature of the oil and of the engine to an optimum level, there is a failure to provide desired operational characteristics of the engine during start up.

The present invention is directed toward alleviating some of the problems which arise when an automotive engine is started during cold weather and the invention is more particularly directed toward the provision of an oil pan which operates to reduce the time required to raise the temperature of the engine lubricating oil to an optimum level.

SUMMARY OF THE INVENTION

Briefly, the present invention may be described as an oil pan assembly for an internal combustion engine comprising means defining an oil pan containing engine lubricating oil therein, with partition wall means being provided for dividing the oil pan into a first oil pan chamber and a second oil pan chamber. The assembly includes oil pump means operating to draw oil from the first oil pan chamber through a pipe containing a strainer and to pump the oil drawn from said first oil pan chamber to the internal combustion engine. The partition wall dividing the oil pan into the first and second oil pan chambers includes therein a temperature responsive valve means which operates to maintain closed flow communication between the second oil pan chamber and the first oil pan chamber when the temperature of the oil is below a predetermined limit. Thus, during the time that the oil temperature is below the predetermined limit, oil for lubricating the engine will be drawn by the oil pump means only from the first oil pan chamber thereby facilitating and accelerating the rise of temperature of the oil being circulated. When the temperature of the oil exceeds the predetermined level, the temperature responsive valve means open to reestablish flow communication between the second oil pan chamber and the first oil pan chamber thereby permitting all of the oil within the oil pan to be circulated through the engine for lubrication.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
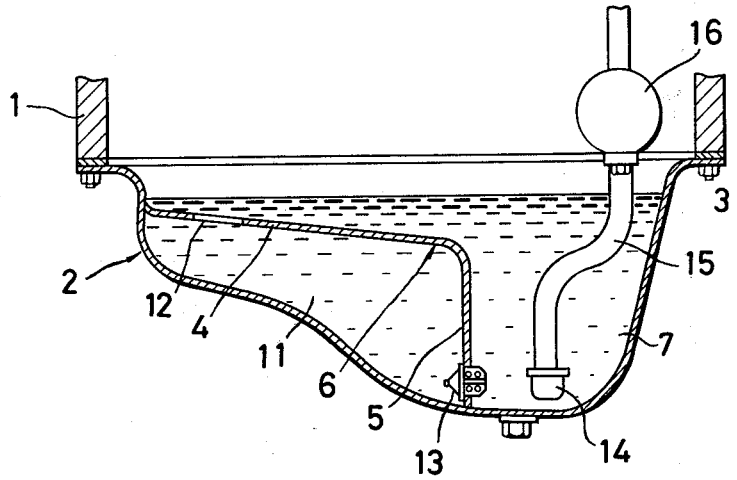
FIG. 1 is a vertical cross-sectional view of an oil pan assembly according to the present invention.
Figure 2:
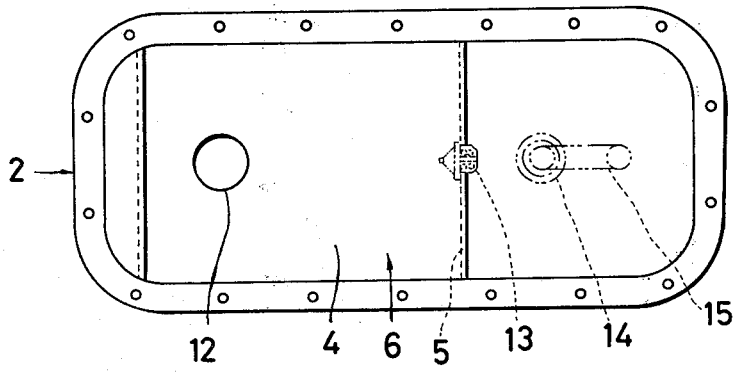
FIG. 2 is a plan view of the oil pan assembly of FIG. 1.

Referring now to the drawing there is shown an oil pan assembly in accordance with the present invention which includes an oil pan 2 installed on the lower part of a cylinder block 1. The interior of the oil pan 2 is partitioned or divided by a partition wall 6 into a main or first oil pan chamber 7 and into a second or subchamber 11. The partition wall 6 consists of an upper member 4 which extends substantially parallel with the upper oil level 3 and a side member 5 which extends in a substantially vertical direction down to the bottom of the oil pan 2. The upper member 4 is formed with an opening 12 having a predetermined area. Provided on the lower portion of the side member 5 is a thermostatic valve 13. In this respect, if the opening 12 is provided in the side member 5, the opening 12 will operate to neutralize the function of the thermostatic valve 13 when the valve 13 is in its closed position to shut off communication between the chambers 7 and 11. Thermostatic type valve 13 operates to close thereby blocking flow communication between the chamber 11 and the chamber 7 when the temperature of the oil within the main chamber 7 is below a given predetermined temperature level.

When the temperature of the oil in the chamber 7 rises above said given predetermined temperature level, the valve 13 opens thereby permitting flow communication to be reestablished between the chamber 11 and the chamber 7.

The assembly includes an oil pump 16 which is mounted in flow communication with the chamber 7 by means of a pipe 15 which extends deep into the main chamber 7 and which is provided with an oil strainer 14 at its lower end. The oil pump is driven to draw or feed oil taken through the oil strainer 14 and through the pipe 15 into the internal combustion engine of an automotive vehicle with the oil being delivered under pressure. Oil which has completed its circulation for lubrication through the respective parts of the engine is returned into the oil pan 2 by gravity.

Thus, during the operation of the device of the present invention, for a given period of time immediately following the start-up of the engine, and assuming that the engine is started during cold weather with the engine oil at a lower temperature, the engine itself will be at a relatively low temperature and the temperature of the oil in the main chamber 7 will also be at a relatively low level. Thus, the thermostatic valve 13 will close thereby blocking communication between the main chamber 7 and the subchamber 11. As a result, the pump 16 will operate to draw oil only from the main chamber 7 and as a result, during the initial engine start-up or warm-up phase of operation, oil will be taken only from the chamber 7 through the oil strainer for circulation through the engine. As a result, the amount of oil which is circulated through the engine will be considerably smaller than the amount which will be circulated if all of the oil in the oil pan 2 were to be available for flow through the pump 16 and to the engine.

As the engine operating time continues after start-up of the engine, the temperature of the oil will be raised above the predetermined level at which the valve 13 is set. Thus, the temperature of the oil in the main chamber 7 will rise to a level sufficient to open the valve 13 thereby permitting the main chamber 7 to be brought into communication with the subchamber 11. After opening of the thermostatic valve 13, oil in the subchamber 11 will flow into the main chamber 7 and as a result, oil from both the chambers 11 and 7 will be fed by way of the oil strainer to the engine so that the total amount of oil in the oil pan will be circulated. Thus, the amount of oil being circulated to the engine is increased and the rise in oil temperature to an optimum level will occur sooner than would otherwise occur in a mechanism not having the partition wall 6 therein.

As will be apparent from the foregoing description of the oil pan assembly according to the present invention, when the temperature of the oil is low, the amount of oil being circulated will be reduced so that the time required for the oil to raise its temperature to an optimum level will be shortened. Accordingly, the operation of an internal combustion engine may be rapidly brought into a stable condition with the result that the lubrication of respective parts of the engine during cold weather may be improved with accompanying improvements in the suppression of generation of harmful emissions and reduction in the consumption of oil.

While a specific embodiment of the invention has been shown and described in detail to illustrate the application of the inventive principles, it will be understood that the invention may be embodied otherwise without departing from such principles.

What is claimed is:

1. An oil pan assembly for an internal combustion engine comprising: means defining an oil pan containing oil therein; partition wall means dividing said oil pan into a first oil pan chamber and a second oil pan chamber; oil pump means; means including a strainer communicating said first oil pan chamber with said oil pump means, said oil pump means operating to deliver oil from said first oil pan chamber to an internal combustion engine; and temperature responsive valve means located in said partition wall means for opening and closing flow communication between said first and second oil pan chambers; said valve means being set to remain closed to block flow communication between said first and second oil pan chambers when the temperature of oil within said oil pan is below a predetermined temperature level thereby causing only oil from said first oil pan chamber to be drawn by said pump means for delivery to said internal combustion engine; said valve means operating to open to establish flow communication between said first and said second oil pan chambers when the temperature of oil within said oil pan rises above said predetermined temperature level thereby to permit oil from said second chamber to flow into said first chamber for circulation to said internal combustion engine.

2. An assembly according to claim 1 wherein said partition wall means consist of an upper wall member extending substantially parallel with the level of oil in said oil pan and a side member extending in a substantially vertical direction.

3. An assembly according to claim 2 wherein said upper member is formed with an opening therein said opening having a given area.

4. An assembly according to claim 2 wherein said temperature responsive valve means are mounted in said side wall member of said partition wall means.

5. An assembly according to claim 4 wherein said temperature responsive valve means is a thermostatic type valve.

* * * * *